US007669843B2

(12) United States Patent
Milillo et al.

(10) Patent No.: US 7,669,843 B2
(45) Date of Patent: Mar. 2, 2010

(54) METHOD AND APPARATUS FOR HIGH CAPACITY STACKING AND STITCHING IN AN IMAGE PRODUCTION DEVICE

(75) Inventors: William D. Milillo, Ontario, NY (US); Joseph Salvatore Vetromile, Rochester, NY (US); Richard J. Milillo, Fairport, NY (US); Gordon B. Reid, Walworth, NY (US); Arthur H. Kahn, Cohocton, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/144,802

(22) Filed: Jun. 24, 2008

(65) Prior Publication Data

US 2009/0315242 A1 Dec. 24, 2009

(51) Int. Cl.
*B65H 33/04* (2006.01)
*B65H 39/00* (2006.01)
*B42B 2/02* (2006.01)

(52) U.S. Cl. ..... 270/58.09; 270/58.08; 270/58.07; 270/58.11; 270/58.12; 270/52.18

(58) Field of Classification Search ..... 270/58.07, 270/58.08, 58.09, 58.11, 58.12, 58.17, 58.18, 270/58.27

See application file for complete search history.

(56) References Cited

U.S. PATENT DOCUMENTS 5,409,201 A * 4/1995 Kramer ..... 270/58.13
5,692,740 A 12/1997 Holtje
2004/0155395 A1* 8/2004 Milillo et al. ..... 270/58.08

* cited by examiner

*Primary Examiner*—Gene Crawford
*Assistant Examiner*—Yolanda Cumbess
(74) *Attorney, Agent, or Firm*—Ronald E. Prass, Jr.; Prass LLP

(57) ABSTRACT

A method and apparatus for high capacity stacking and stitching in an image production device is disclosed. The method may include determining if an image production document is to be stitched, wherein if it is determined that the image production document is to be stitched, sending the image production document along a first paper path to a first stacking tray to be stitched and stacked, and if it is determined that the image production document is not to be stitched, determining if the image production document requires a higher quality registration stacking than the stacking provided at the first stacking tray, wherein if it is determined that the image production document requires a higher quality registration stacking than the stacking provided at the first stacking tray, sending the image production document along a second paper path to a second stacking tray to be stacked in a high quality registration manner, and if the image production document is determined not to require a higher quality registration stacking than the stacking provided at the first stacking tray, sending the image production document along one of the first paper path to the first stacking tray to be stacked and the second paper path to the second stacking tray to be stacked.

21 Claims, 4 Drawing Sheets

METHOD AND APPARATUS FOR HIGH CAPACITY STACKING AND STITCHING IN AN IMAGE PRODUCTION DEVICE

BACKGROUND

Disclosed herein are a method for high capacity stacking and stitching in an image production device, as well as corresponding apparatus and computer-readable medium.

In today's marketplace, there is an ever increasing need for high end, high capacity stackers with stitching or stapling capability. Stack quality for unstitched output is typically held to a smaller misregistration specification than stitched output. Typically, finishers capable of stitching output do so by trading off misregistration and/or stack quality of unstitched output. Also, customers have stated the need for finishing devices to provide unstitched and stitched output within a single run or job.

SUMMARY

A method and apparatus for high capacity stacking and stitching in an image production device is disclosed. The method may include determining if an image production document is to be stitched, wherein if it is determined that the image production document is to be stitched, sending the image production document along a first paper path to a first stacking tray to be stitched and stacked, and if it is determined that the image production document is not to be stitched, determining if the image production document requires a higher quality registration stacking than the stacking provided at the first stacking tray, wherein if it is determined that the image production document requires a higher quality registration stacking than the stacking provided at the first stacking tray, sending the image production document along a second paper path to a second stacking tray to be stacked in a high quality registration manner, and if the image production document is determined not to require a higher quality registration stacking than the stacking provided at the first stacking tray, sending the image production document along one of the first paper path to the first stacking tray to be stacked and the second paper path to the second stacking tray to be stacked.

DETAILED DESCRIPTION

Figure 1:
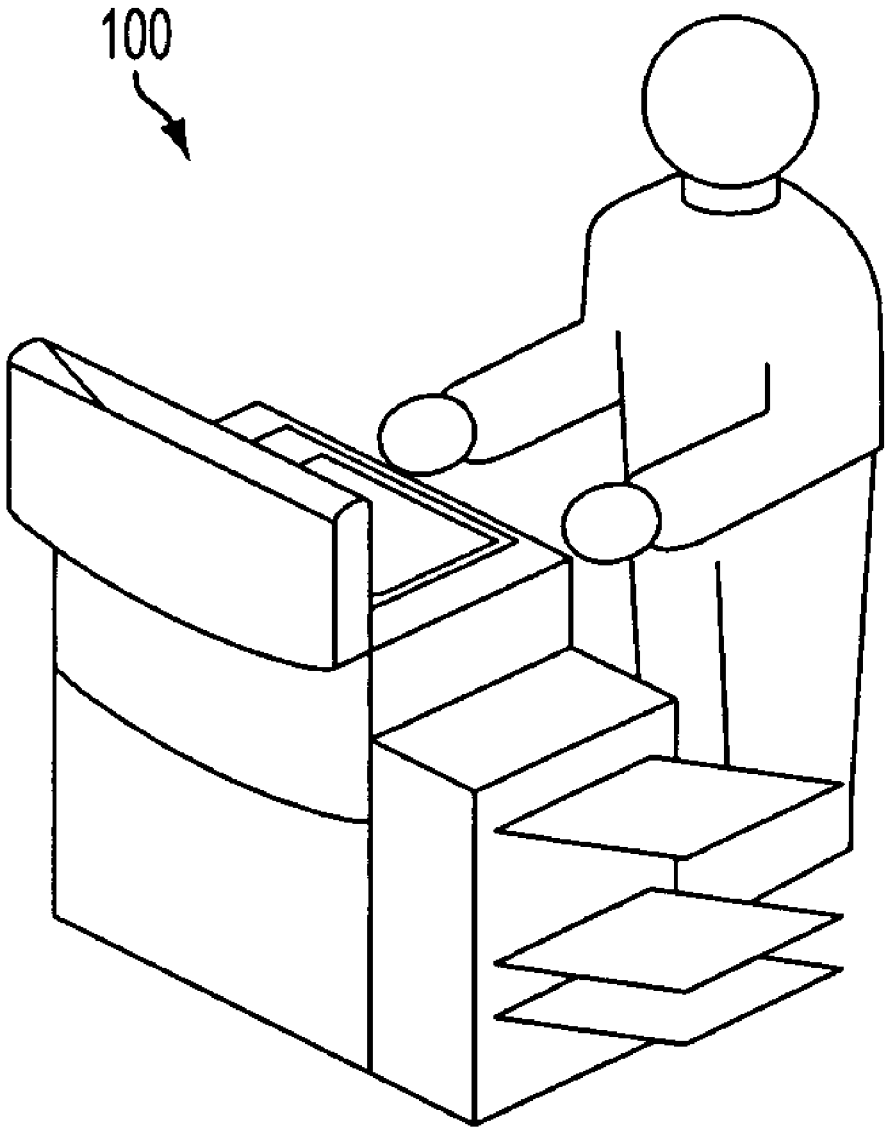
FIG. 1 illustrates an exemplary diagram of an image production device in accordance with one possible embodiment of the disclosure.

Aspects of the embodiments disclosed herein relate to a method for high capacity stacking and stitching in an image production device, as well as corresponding apparatus and computer-readable medium.

The disclosed embodiments may include a method for high capacity stacking and stitching in an image production device. The method may include determining if an image production document is to be stitched, wherein if it is determined that the image production document is to be stitched, sending the image production document along a first paper path to a first stacking tray to be stitched and stacked, and if it is determined that the image production document is not to be stitched, determining if the image production document requires a higher quality registration stacking than the stacking provided at the first stacking tray, wherein if it is determined that the image production document requires a higher quality registration stacking than the stacking provided at the first stacking tray, sending the image production document along a second paper path to a second stacking tray to be stacked in a high quality registration manner, and if the image production document is determined not to require a higher quality registration stacking than the stacking provided at the first stacking tray, sending the image production document along one of the first paper path to the first stacking tray to be stacked and the second paper path to the second stacking tray to be stacked.

The disclosed embodiments may further include an image production device that may include a first paper path, a second paper path, a first stacking tray that receives image production image production documents from the first paper path, a second stacking tray that receives image production image production documents from the second paper path, and a high capacity stacking and stitching controller that determines if an image production document is to be stitched, wherein if the high capacity stacking and stitching controller determines that the image production document is to be stitched, the high capacity stacking and stitching controller sends the image production document along the first paper path to the first stacking tray to be stitched and stacked, and if the high capacity stacking and stitching controller determines that the image production document is not to be stitched, the high capacity stacking and stitching controller determines if the image production document requires a higher quality registration stacking than the stacking provided at the first stacking tray, wherein if the high capacity stacking and stitching controller determines that the image production document requires a higher quality registration stacking than the stacking provided at the first stacking tray, the high capacity stacking and stitching controller sends the image production document along the second paper path to the second stacking tray to be stacked in a high quality registration manner, and if the high capacity stacking and stitching controller determines that the image production document does not to require a higher quality registration stacking than the stacking provided at the first stacking tray, the high capacity stacking and stitching controller sends the image production document along one of the first paper path to the first stacking tray to be stacked and the second paper path to the second stacking tray to be stacked.

The disclosed embodiments may further include a high capacity stacking and stitching module for an image production device. The high capacity stacking and stitching module may include a first paper path, a second paper path, a first stacking device that receives image production documents from the first paper path, a second stacking device located adjacent to the first stacking device that receives image production documents from the second paper path, a first stacking tray that receives image production documents from the first stacking device, and a second stacking tray that receives image production documents from the second stacking device, wherein the first stacking device stacks image production documents onto the first stacking tray that are both stitched and unstitched and the second stacking device stacks image production documents onto the second stacking tray that are only unstitched.

This disclosure may concern a finisher architecture that may include two separate disc style stackers each servicing independent output stacking trays within a single module. The first stacking device (e.g., disc stacker) may be capable of providing stitched and unstitched output, while the second stacking device may be designed to only provide unstitched output, for example. Dedicating one stacking device for only unstitched output may eliminate the tradeoffs which are made by providing stitching capability. Typical conventional systems have relied on "chunking" modes of operation which compile small sets (typically up to 100 sheets in order to enable a subsequent stitching operation) and then ejecting these small unstitched sets onto the stacking tray. This operating scenario results in degraded stack quality for unstitched sets.

The "dedicated unstitched" output stacker may stack the output directly onto the stacking tray up to the full capacity of the tray. Although this stack capacity is only limited by the design and space constraints of the product, a stack capacity of 5000, 10,000, etc. may be possible for each tray. This operating scenario provides for a minimal amount of stack scatter, thereby resulting in typically higher stack quality in regards to sheet to sheet registration.

The "stitched and unstitched" stacking device may be equipped to provide stitched output and "degraded" unstitched output due to the design tradeoff described above. In this manner, the user may be provided with high quality stitched output (from the second stacking device) but also has the option of doubling their unstitched stacking capacity if unstitched stack quality can be less precise for the first stacking device.

In addressing jobs that contain both stitched and unstitched output, the user could have the option of directing unstitched output to the dedicated "high quality" second stacking device and directing the stitched output to the stitching enabled first stacking device. By separating the output, the stack quality of the unstitched output may not be degraded by the stitching enabling operation of the first stacking device.

In addition, the disclosure may also include an "unload while run" feature since one tray can be unloaded while the other is stacking. Although the above mentioned functions could be provided by two separate modules (e.g., one for unstitched output and one for stitched output), the advantage of providing both stackers in one module may minimize footprint and unit manufacturing cost (UMC) while offering the feature of modularity by allowing the customer to purchase a module equipped with a "Stitching Only", "Stacker Only" or "Both Stacking and Stitching Module," for example. These various levels of modularity may be upgradeable in the field.

FIG. 1 illustrates an exemplary diagram of an image production device 100 in accordance with one possible embodiment of the disclosure. The image production device 100 may be any device that may be capable of making image production documents (e.g., copies, etc.) including a copier, a printer, an office copier, a high-capacity copier, a commercial copier, a facsimile device, and a multi-function device (MFD), for example.

Figure 2:
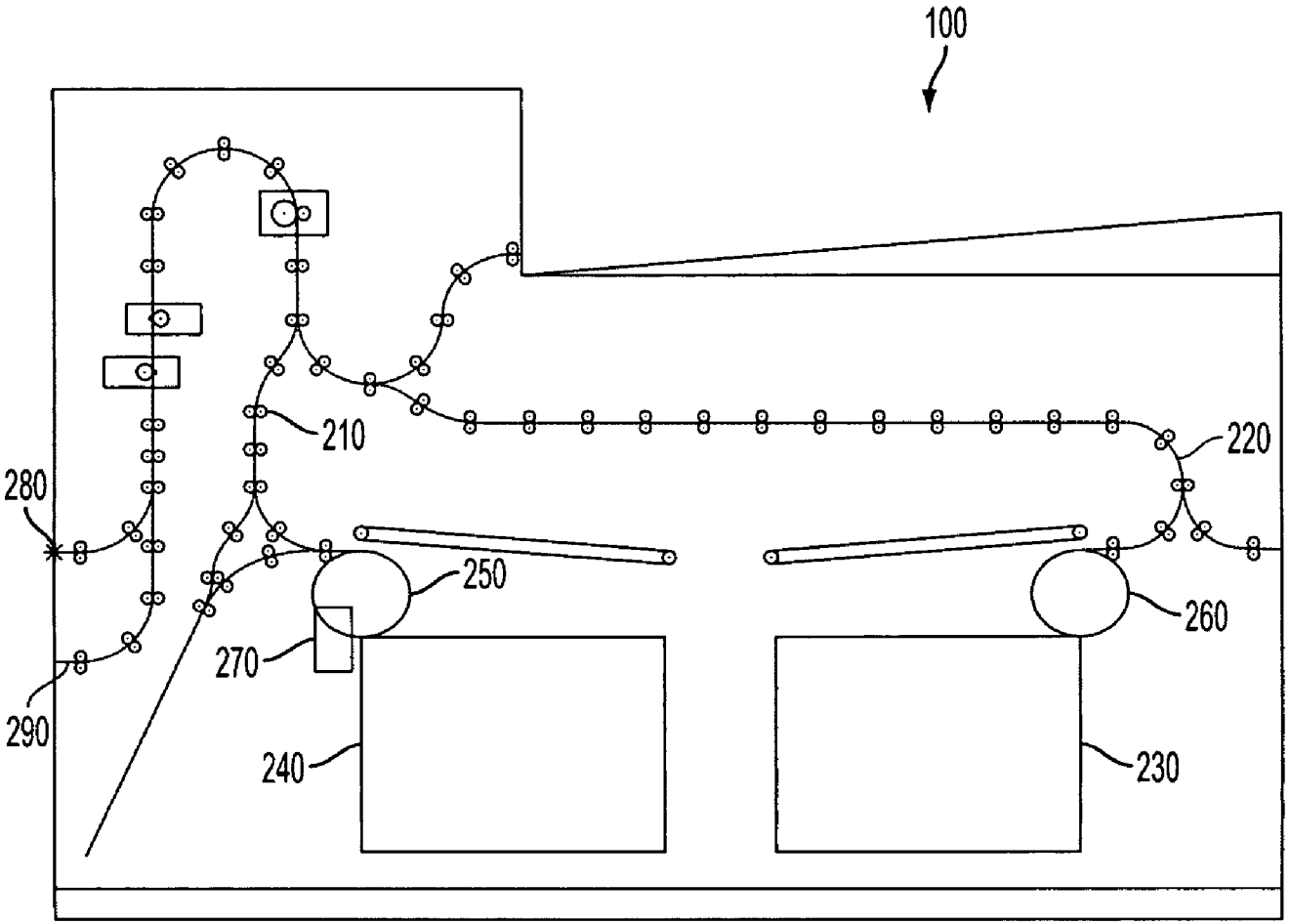
FIG. 2 illustrates a diagram of the image production device in accordance with one possible embodiment of the disclosure.

FIG. 2 illustrates a diagram of an image production device 100 in accordance with one possible embodiment of the disclosure. The image production device 100 may include two paper input slots 280, 290, a first paper path 210 that leads to a first stacking device (e.g., disc stacker) 250, stitching device 270, and a first stacking tray 240, a second paper path 220 that leads to a second stacking device 260 and a second stacking tray 230. Portions of the first paper path 210 and the second paper path 220, along with the first stacking device 250, the stitching device 270, the first stacking tray 240, the second stacking device 260, and the second stacking tray 230 may be included in a single module.

While disc stackers are shown as examples of the first and second stacking devices 250, 260, other stacking devices known to those of skill in the art may be used within the spirit and scope of the disclosure. The arrangement of the stacking trays 230, 240 in the image production device 100, etc. may be adjacent/side-by-side (as shown), vertically stacked, one placed in front of the other, staggered, etc., for example. The first paper path 210 and the second paper path 220 may share the same path for at least a portion of the total paper path. However, the paper paths may split at some point in the total paper path to enable the paper to be fed to its intended stacking device and stacking tray based on its registration, stitching, stapling, finishing, etc. requirements.

Stitching device 270 may represent any wire-based or other binding/fastening device, including a stitcher, stapler, binding device, etc. "Stitching" concerns the use of wire fastenings from a spool of wire that are measured and cut by the image production device 100 to fit the size of the image production document to be fastened. Stacking trays 230, 240 may be any stacking tray known to one of skill in the art that may allow high capacity stacking. In particular, the stacking trays 230, 240 may be of the type that moves vertically up and down depending on the amount of paper stacked in the tray. In addition, image production documents may be unloaded from one of the first and second stacking tray while image production documents are being stacked on the other of the first and second stacking tray.

It is to be noted that the first stacking device 250 may be opposite or "backwards" with respect to the second stacking device 260 (i.e., the image production documents are received from opposite sides). It may also be noted that the first stacking device 250 may have stitching (or stapling) capability and the second stacking device 260 may not. These features may be related in the sense that if one stacking device is backwards relative to the other, one may not be able to use stitching on the backwards stack because, for instance, the nails of the staples will come out the front of the stapled set, or the papers will be arranged with the back of the first page facing outward. Thus, if one knows that papers in the backward stack may never be stapled, etc., one may not care that the image production documents may be stacked upside down.

Figure 3:
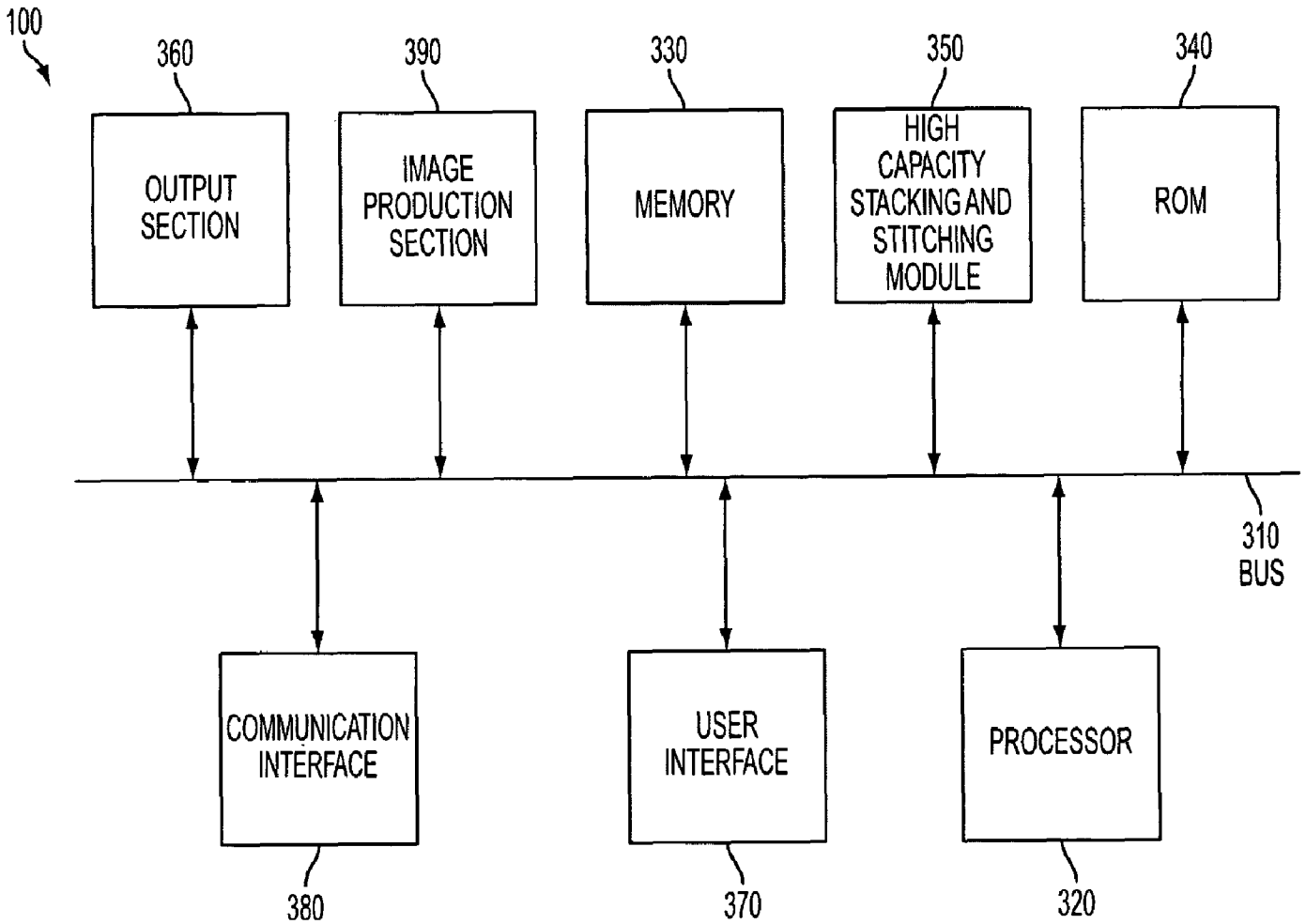
FIG. 3 illustrates a block diagram of the image production device in accordance with one possible embodiment of the disclosure.

FIG. 3 illustrates a block diagram of the image production device 100 in accordance with one possible embodiment of the disclosure. The image production device 100 may include a bus 310, a processor 320, a memory 330, a read only memory (ROM) 340, a high capacity stacking and stitching controller 350, a user interface 360, an output section 370, a communication interface 380, and an image production section 390. Bus 310 may permit communication among the components of the image production device 100.

Processor 320 may include at least one conventional processor or microprocessor that interprets and executes instructions. Memory 330 may be a random access memory (RAM) or another type of dynamic storage device that stores information and instructions for execution by processor 320. Memory 330 may also include a read-only memory (ROM) which may include a conventional ROM device or another type of static storage device that stores static information and instructions for processor 320.

Communication interface 380 may include any mechanism that facilitates communication via a network. For example, communication interface 380 may include a modem. Alternatively, communication interface 380 may include other mechanisms for assisting in communications with other devices and/or systems.

ROM 340 may include a conventional ROM device or another type of static storage device that stores static information and instructions for processor 320. A storage device may augment the ROM and may include any type of storage media, such as, for example, magnetic or optical recording media and its corresponding drive.

User interface 360 may include one or more conventional mechanisms that permit a user to input information to and interact with the image production unit 100, such as a keyboard, a display, a mouse, a pen, a voice recognition device, touchpad, buttons, etc., for example. Output section 370 may include one or more conventional mechanisms that output image production documents to the user, including output trays, output paths, finishing section, etc., for example. The image processing section 390 may include an image printing section, a scanner, a fuser, etc., for example.

The image production device 100 may perform such functions in response to processor 320 by executing sequences of instructions contained in a computer-readable medium, such as, for example, memory 330. Such instructions may be read into memory 330 from another computer-readable medium, such as a storage device or from a separate device via communication interface 380.

The image production device 100 illustrated in FIGS. 1-3 and the related discussion are intended to provide a brief, general description of a suitable communication and processing environment in which the disclosure may be implemented. Although not required, the disclosure will be described, at least in part, in the general context of computer-executable instructions, such as program modules, being executed by the image production device 100, such as a communication server, communications switch, communications router, or general purpose computer, for example.

Generally, program modules include routine programs, objects, components, data structures, etc. that perform particular tasks or implement particular abstract data types. Moreover, those skilled in the art will appreciate that other embodiments of the disclosure may be practiced in communication network environments with many types of communication equipment and computer system configurations, including personal computers, hand-held devices, multi-processor systems, microprocessor-based or programmable consumer electronics, and the like.

Figure 4:
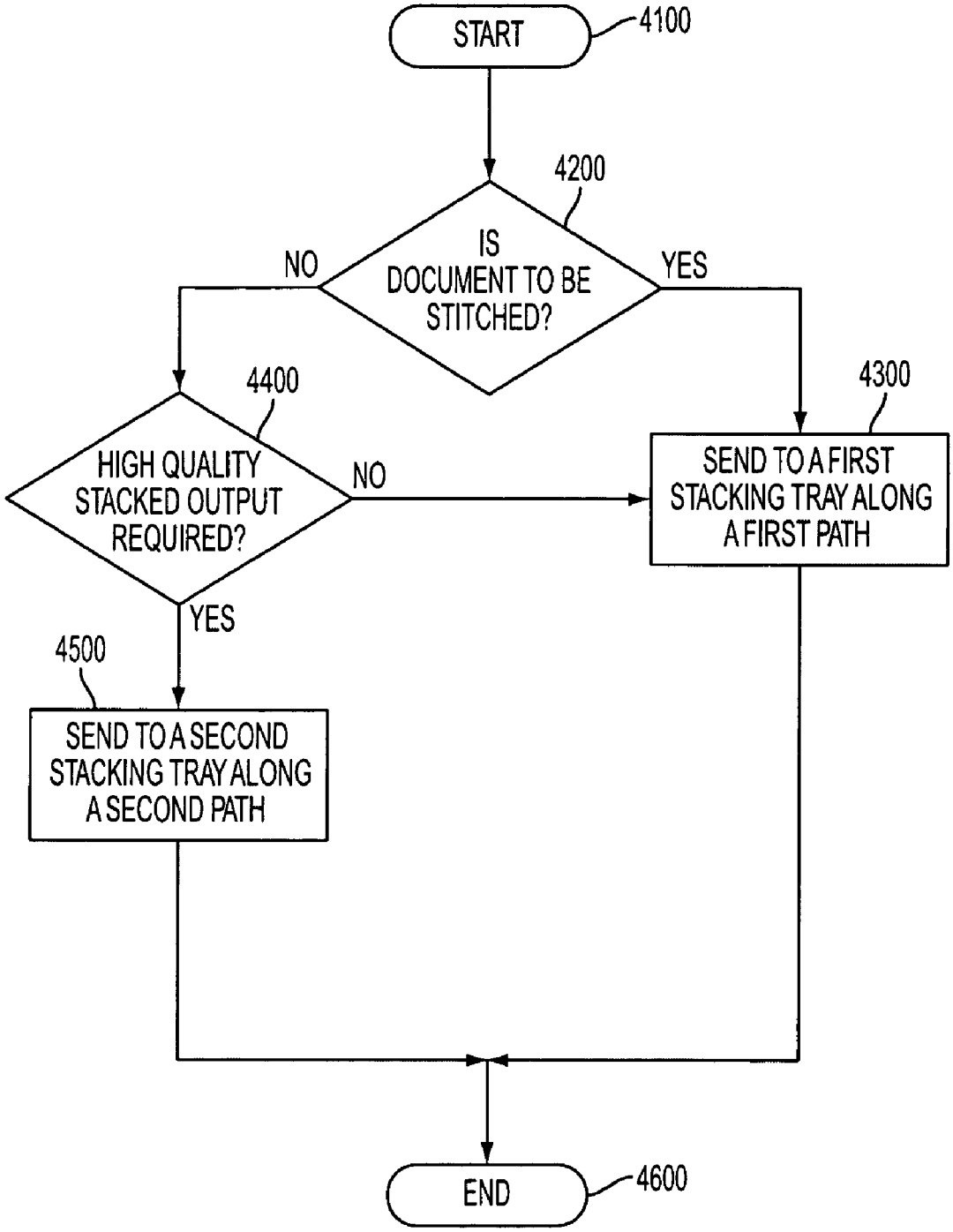
FIG. 4 is a flowchart of an exemplary high capacity stacking and stitching process in accordance with one possible embodiment of the disclosure.

For illustrative purposes, the operation of the high capacity stacking and stitching controller 350 and the exemplary high capacity stacking and stitching process are described in FIG. 4 in relation to the block diagrams shown in FIGS. 1-3.

FIG. 4 is a flowchart of an exemplary high capacity stacking and stitching process in accordance with one possible embodiment of the disclosure. The method begins at 4100, and continues to 4200 where the high capacity stacking and stitching controller 350 may determine if an image production document is to be stitched. In this manner, the image production documents to be stitched or highly registered may be determined based on the input tray, slot, etc., for example. However, the high capacity stacking and stitching controller 350 may prompt the user to select image production document registration and stitching requirements, such as identifying the image production documents to be stitched, highly registered, etc., for example. The high capacity stacking and stitching controller 350 may receive the user's selected image production document registration and stitching requirements and then implement the user's received selected image production document registration and stitching requirements, for example.

If the high capacity stacking and stitching controller 350 determines that the image production document is to be stitched, at step 4300, the high capacity stacking and stitching controller 350 may send the image production document along the first paper path 210 to the first stacking tray 240 to be stitched by the stitching device 270 and stacked. The process may then go to step 4600 and end.

If at step 4200, the high capacity stacking and stitching controller 350 determines that the image production document is not to be stitched, then at step 4400, the high capacity stacking and stitching controller 350 may determine if the image production document requires a higher quality registration stacking than the stacking provided at the first stacking tray. Registration may be defined as the alignment of one image production document in relation to another image production document. High quality registration may require that the edges of each document align in a near-perfect manner with each other document in the stack.

If the high capacity stacking and stitching controller 350 determines that the image production document requires a higher quality registration stacking than the stacking provided at the first stacking tray 240, then at step 4500, the high capacity stacking and stitching controller 350 may send the image production document along a second paper path 220 to a second stacking tray 230 to be stacked in a high quality registration manner. The process may then go to step 4600 and end.

If at step 4400, the high capacity stacking and stitching controller 350 determines that the image production document is not required to have a higher quality registration stacking than the stacking provided at the first stacking tray 240, than the process goes to step 4300 where the high capacity stacking and stitching controller 350 may send the image production document along either the first paper path 210 to the first stacking tray 240 to be stacked or the second paper path 220 to the second stacking tray 240 to be stacked. The process may then go to step 4600 and end.

Embodiments as disclosed herein may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hard-wired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, and the like that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described therein. It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method for high capacity stacking and stitching in an image production device, comprising:

determining if an image production document is to be stitched, wherein if it is determined that the image production document is to be stitched, sending the image production document along a first paper path to a first stacking tray to be stitched and stacked, and if it is determined that the image production document is not to be stitched, determining if the image production document requires a higher quality registration stacking than the stacking provided at the first stacking tray, wherein if it is determined that the image production document requires a higher quality registration stacking than the stacking provided at the first stacking tray, sending the image production document along a second paper path to a second stacking tray to be stacked in a high quality registration manner, and if the image production document is determined not to require a higher quality registration stacking than the stacking provided at the first stacking tray, sending the image production document along one of the first paper path to the first stacking tray to be stacked and the second paper path to the second stacking tray to be stacked.

2. The method of claim 1, wherein image production documents may be unloaded from one of the first and second stacker while image production documents are being stacked on the other of the first and second stacker.

3. The method of claim 1, wherein the first stacking tray is located one of adjacent to, to the left of, to the right of, above, below, in front of, and behind, the second stacking tray.

4. The method of claim 1, wherein stacking onto the first stacking tray is performed by a first stacking device and stacking onto the second stacking tray is performed by a second stacking device.

5. The method of claim 1, further comprising:

prompting the user to select at least one of image production document registration and stitching requirements;

receiving the user's selected image production document registration and stitching requirements; and implementing the user's received selected image production document registration and stitching requirements.

6. The method of claim 1, wherein stitching is performed by one of a stitching device, stapler, and binding device.

7. The method of claim 1, wherein the image production device is one of a copier, a printer, an office copier, a high-capacity copier, a commercial copier, a facsimile device, and a multi-function device.

8. An image production device, comprising:

a first paper path;

a second paper path;

a first stacking tray that receives image production documents from the first paper path;

a second stacking tray that receives image production documents from the second paper path; and a high capacity stacking and stitching controller that determines if an image production document is to be stitched, wherein if the high capacity stacking and stitching controller determines that the image production document is to be stitched, the high capacity stacking and stitching controller sends the image production document along the first paper path to the first stacking tray to be stitched and stacked, and if the high capacity stacking and stitching controller determines that the image production document is not to be stitched, the high capacity stacking and stitching controller determines if the image production document requires a higher quality registration stacking than the stacking provided at the first stacking tray, wherein if the high capacity stacking and stitching controller determines that the image production document requires a higher quality registration stacking than the stacking provided at the first stacking tray, the high capacity stacking and stitching controller sends the image production document along the second paper path to the second stacking tray to be stacked in a high quality registration manner, and if the high capacity stacking and stitching controller determines that the image production document does not to require a higher quality registration stacking than the stacking provided at the first stacking tray, the high capacity stacking and stitching controller sends the image production document along one of the first paper path to the first stacking tray to be stacked and the second paper path to the second stacking tray to be stacked.

9. The image production device of claim 8, wherein image production documents may be unloaded from one of the first and second stacking tray while image production documents are being stacked on the other of the first and second stacking tray.

10. The image production device of claim 8, wherein the first stacking tray is located one of adjacent to, to the left of, to the right of, above, below, in front of, and behind, the second stacking tray.

11. The image production device of claim 8, further comprising:

a first stacking device that stacks image production image production documents onto the first stacking tray; and a second stacking device that stacks image production image production documents onto the second stacking tray.

12. The image production device of claim 8, wherein the high capacity stacking and stitching controller prompts the user to select at least one of image production document registration and stitching requirements, receives the user's selected image production document registration and stitching requirements, and implements the user's received selected image production document registration and stitching requirements.

13. The image production device of claim 8, further comprising:

a stitching device that performs stitching of the image production documents, wherein the stitching device is one of a stitcher, a stapler, and a binding device.

14. The image production device of claim 8, wherein the image production device is one of a copier, a printer, an office copier, a high-capacity copier, a commercial copier, a facsimile device, and a multi-function device.

15. A high capacity stacking and stitching module for an image production device, comprising:

a first paper path;

a second paper path;

a first stacking device that receives image production documents from the first paper path;

a second stacking device located adjacent to the first stacking device that receives image production documents from the second paper path;

a first stacking tray that receives image production documents from the first stacking device; and a second stacking tray that receives image production documents from the second stacking device, wherein the first stacking device stacks image production documents onto the first stacking tray that are both stitched and unstitched and the second stacking device stacks image production documents onto the second stacking tray that are only unstitched, wherein if it is determined that an image production document requires a higher quality registration stacking than the stacking provided at the first stacking tray, the image production document is sent along the second paper path to the second stacking tray to be stacked in a high quality registration manner, and if the image production document is determined not to require a higher quality registration stacking than the stacking provided at the first stacking tray, the image production document is sent along one of the first paper path to the first stacking tray to be stacked and the second paper path to the second stacking tray to be stacked.

16. The high capacity stacking and stitching module of claim 15, wherein image production documents may be unloaded from one of the first and second stacking tray while image production documents are being stacked on the other of the first and second stacking tray.

17. The high capacity stacking and stitching module of claim 15, wherein the first stacking tray is located one of to the left of, to the right of, above, below, in front of, and behind, the second stacking tray.

18. The high capacity stacking and stitching module of claim 15, wherein the first and second stacking devices are disc stackers.

19. The high capacity stacking and stitching module of claim 15, wherein the first stacking device receives image production documents from a first direction and the second stacking device receives image production documents from a second direction.

20. The high capacity stacking and stitching module of claim 15, further comprising:

a stitching device that performs stitching of the image production documents, wherein the stitching device is one of a stitcher, a stapler, and a binding device.

21. The high capacity stacking and stitching module of claim 15, wherein the image production device is one of a copier, a printer, an office copier, a high-capacity copier, a commercial copier, a facsimile device, and a multi-function device.

* * * * *